US005682462A

United States Patent [19]

Huang et al.

[11] Patent Number: 5,682,462

[45] Date of Patent: Oct. 28, 1997

[54] VERY LOW BIT RATE VOICE MESSAGING SYSTEM USING VARIABLE RATE BACKWARD SEARCH INTERPOLATION PROCESSING

[75] Inventors: Jian-Cheng Huang, Lake Worth; Floyd Simpson, Lantana; Xiaojun Li, Boynton Beach, all of Fla.

[73] Assignee: Motorola, Inc., Schaumburg, Ill.

[21] Appl. No.: 528,033

[22] Filed: Sep. 14, 1995

[51] Int. Cl.[6] ..... G10L 9/00

[52] U.S. Cl. ..... 395/2.28

[58] Field of Search ..... 395/2.28, 2.31; 381/34

[56] References Cited

U.S. PATENT DOCUMENTS

| | | | |
|---|---|---|---|
| 4,479,124 | 10/1984 | Rodriguez et al. . | |
| 4,701,943 | 10/1987 | Davis et al. . | |
| 4,802,221 | 1/1989 | Jibbe | 381/34 |
| 4,815,134 | 3/1989 | Picone et al. | 395/2.31 |
| 5,357,546 | 10/1994 | Meriwether et al. | 375/122 |
| 5,388,146 | 2/1995 | Morduch et al. | 379/52 |
| 5,544,277 | 8/1996 | Bakis et al. | 395/2.2 |

OTHER PUBLICATIONS

Jayant and Noll, *Digital Coding of Waveforms—Principles and Applications to Speech and Video*, pp. 510–523 and pp. 546–563, Prentice–Hall, Inc., Englewood Cliffs, NJ, 1984.

Gersho and Gray, *Vector Quantization and Signal Compression*, pp. 605–626, Kluwer Academic Publishers, Norwell, MA, 1992.

*Primary Examiner*—Allen R. MacDonald
*Assistant Examiner*—Susan Wieland
*Attorney, Agent, or Firm*—Philip P. Macnak

[57] ABSTRACT

A method and apparatus is provided for a low bit rate speech transmission. Speech spectral parameter vectors are generated from a voice message and stored in a sequence of speech spectral parameter vectors within a speech spectral parameter matrix. A first index identifying a first speech parameter template corresponding to a first speech spectral parameter vector of the sequence of speech spectral parameter vectors is transmitted. A subsequent speech spectral parameter vector of the sequence is selected and a subsequent speech parameter template is determined having a subsequent index. One or more intervening interpolated speech parameter templates are interpolated between the first speech parameter template and the subsequent speech parameter template. The one or more intervening speech spectral parameter vectors are compared to the corresponding one or more intervening interpolated speech parameter templates to derive a distance. The subsequent index is transmitted when the distance derived is less than or equal to a predetermined distance.

32 Claims, 11 Drawing Sheets

314

412

VERY LOW BIT RATE VOICE MESSAGING SYSTEM USING VARIABLE RATE BACKWARD SEARCH INTERPOLATION PROCESSING

FIELD OF THE INVENTION

This invention relates generally to communication systems, and more specifically to a compressed voice digital communication system providing very low data transmission rates using variable rate backward search interpolation processing.

BACKGROUND OF THE INVENTION

Communications systems, such as paging systems, have had to in the past compromise the length of messages, number of users and convenience to the user in order to operate the system profitably. The number of users and the length of the messages were limited to avoid over crowding of the channel and to avoid long transmission time delays. The user's convenience is directly effected by the channel capacity, the number of users on the channel, system features and type of messaging. In a paging system, tone only pagers that simply alerted the user to call a predetermined telephone number offered the highest channel capacity but were some what inconvenient to the users. Conventional analog voice pagers allowed the user to receive a more detailed message, but severally limited the number of users on a given channel. Analog voice pagers, being real time devices, also had the disadvantage of not providing the user with a way of storing and repeating the message received. The introduction of digital pagers with numeric and alphanumeric displays and memories overcame many of the problems associated with the older pagers. These digital pagers improved the message handling capacity of the paging channel, and provide the user with a way of storing messages for later review.

Although the digital pagers with numeric and alpha numeric displays offered many advantages, some user's still preferred pagers with voice announcements. In an attempt to provide this service over a limited capacity digital channel, various digital voice compression techniques and synthesis techniques have been tried, each with their own level of success and limitation. Standard digital voice compression methods, used by two way radios also failed to provide the degree of compression required for use on a paging channel. Other techniques offering a high compression ratio tend to distort the speech especially during periods of rapidly changing speech. Voice messages that are digitally encoded using the current state of the art would monopolize such a large portion of the channel capacity or unacceptably distort the speech that they may render the system commercially unsuccessful.

Accordingly, what is needed for optimal utilization of a channel in a communication system, such as the paging channel in a paging system, is an apparatus that digitally encodes voice messages in such a way that the resulting data is very highly compressed while maintaining acceptable speech quality and can easily be mixed with the normal data sent over the communication channel. In addition what is needed is a communication system that digitally encodes the voice message in such a way that processing in the communication receiving device, such as a pager, is minimized.

SUMMARY OF THE INVENTION

Briefly, according to a first aspect of the invention there is provided a method for providing a low bit rate speech transmission. Speech spectral parameter vectors which are generated from a voice message are stored in a sequence within a speech parameter matrix, and an index identifying a speech parameter template corresponding to a selected speech spectral parameter vector of the sequence is transmitted. Thereafter the method comprises the steps of selecting a subsequent speech spectral parameter vector of the sequence to establish one or more intervening speech spectral parameter vectors with respect to the selected speech spectral parameter vector; determining a subsequent index identifying a subsequent speech spectral parameter template which corresponds to the subsequent speech spectral parameter vector of the sequence; interpolating between the speech parameter template and the subsequent speech parameter template to derive one or more intervening interpolated speech parameter templates; comparing the one or more intervening speech spectral parameter vectors which correspond to the one or more intervening interpolated speech parameter templates to derive a distance; and transmitting the subsequent index when the distance derived is less than or equal to a predetermined distance.

According to a second aspect of the present invention, a voice compression processor processes a voice message to provide a low bit rate speech transmission. The voice compression processor comprises a memory, an input speech processor, a signal processor and a transmitter. The memory stores speech parameter templates and indexes identifying the speech parameter templates. The input speech processor processes the voice message to generate speech spectral parameter vectors which are stored within said memory. The signal processor programmed to select a speech spectral parameter vector from the speech spectral parameter vectors stored within the memory, to determine an index identifying a speech parameter template which corresponds to the selected speech spectral parameter vector, to select a subsequent speech spectral parameter vector from the speech spectral parameter vectors stored within the memory, the subsequent speech spectral parameter vector establishing one or more intervening speech spectral parameter vectors with respect to the selected speech spectral parameter vector, to determine a subsequent index identifying a subsequent speech parameter template which corresponds to the subsequent speech spectral parameter vector, to interpolate between the speech parameter template and the subsequent speech spectral parameter template to derive one or more intervening interpolated speech parameter templates, and to compare the one or more intervening speech spectral parameter vectors which correspond to the one or more intervening interpolated speech parameter templates to derive a distance. The transmitter is responsive to the signal processor for transmitting the index, and thereafter for transmitting the subsequent index when the distance derived is less than or equal to a predetermined distance.

According to a third aspect of the present invention, a method for processing a low bit rate speech transmission to provide a voice message comprises the steps of receiving an index, at least a subsequent index and a value indicating a number of intervening speech spectral parameter vectors; selecting a speech parameter template which corresponds to the index and at least a subsequent speech parameter template which corresponds to the at least subsequent index from a set of predetermined speech parameter templates; interpolating between the selected speech parameter template and the at least subsequent speech parameter template to derive a number of intervening speech parameter templates corresponding to the number of intervening speech spectral parameter vectors; synthesizing speech data from the selected speech parameter template, the subsequent speech parameter template, and the intervening speech parameter templates; and generating the voice message from the speech data synthesized.

According to a fourth aspect of the present invention, a communications device receives a low bit rate speech transmission to provide a voice message. The communications device comprise a memory, a receiver, a signal processor a synthesizer and a converter. The memory stores a set of speech parameter templates. The receiver receives an index, at least a subsequent index and a value indicating a number of intervening speech spectral parameter vectors. The signal processor programmed to select a speech parameter template which corresponds to the index and at least a subsequent speech parameter template which corresponds to the at least subsequent index from the set of predetermined speech parameter templates, and to interpolate between the speech parameter template and the at least a subsequent speech parameter template to derive a number of intervening speech parameter templates which corresponds to the number of intervening speech spectral parameter vectors. The synthesizer synthesizing speech data from the speech parameter template, the subsequent speech parameter template, and the intervening speech parameter templates. The converter generates the voice message from the speech data synthesized.

DESCRIPTION OF A PREFERRED EMBODIMENT

Figure 1:
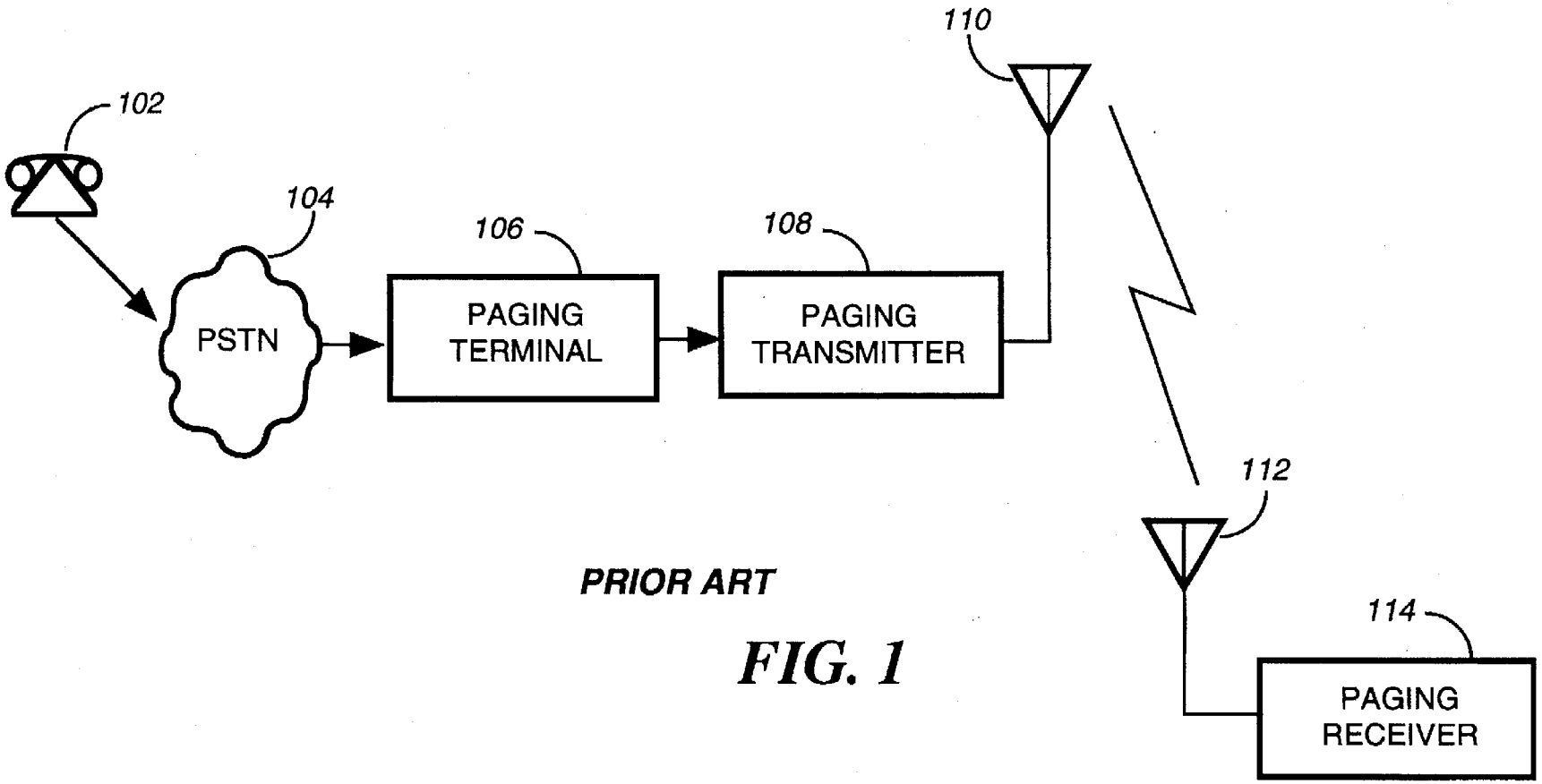
PRIOR ART FIG. 1
FIG. 1 is a block diagram of a communication system.

FIG. 1 shows a block diagram of a communications system, such as a paging system which can utilize the very low bit rate speech transmission using variable rate backward search interpolation processing in accordance with the present invention, to be described below. As will be described in detail below the paging terminal 106 analyzes speech data and generates excitation parameters and spectral parameters representing the speech data. Code book indexes corresponding to Linear Predictive Code (LPC) templates representing the spectral information of the segments original voice message are generated by the paging terminal 106. The paging terminal 106 then reduces the quantity of data that must be transmitted to communicate the spectral information by only transmitting an index of one speech parameter template and a number that indicates the number of speech parameter templates that are to be generated by interpolation. The present invention utilizes a variable rate interpolation process that continuously adjusts the number of speech parameter template to be generated by interpolation. The continuous adjustment of the number of speech parameter template to be generated by interpolation makes it possible to reduce the number of speech parameter template being interpolated during periods of rapidly changing speech, and to increase the number of speech parameter templates being generated by interpolation during periods of slowly changing speech while maintaining a low distortion speech transmission at a very low bit rate, as will be described below.

The digital voice compression process is adapted to the non-real time nature of paging and other non-real time communications systems which provide the time required to perform a highly computational intensive process on very long voice segments. In a non-real time communication there is sufficient time to receive an entire voice message and then process the message. Delays of up to two minutes can readily be tolerated in paging systems where delays of two seconds are unacceptable in real time communication systems. The asymmetric nature of the digital voice compression process described herein minimizes the processing required to be performed in a portable communications device 114, such as a pager, making the process ideal for paging applications and other similar non-real time voice communications. The highly computational intensive portion of the digital voice compression process is performed in a fixed portion of the system and as a result little computation is required to be performed in the portable portion of the system as will be described below.

By way of example, a paging system will be utilized to describe the present invention, although it will be appreciated that any non-real time communication system will benefit from the present invention as well. A paging system is designed to provide service to a variety of users each requiring different services. Some of the users will require numeric messaging services, other users alpha-numeric messaging services, and still other users may require voice messaging services. In a paging system, the caller originates a page by communicating with a paging terminal 106 via a telephone 102 through the public switched telephone network (PSTN) 104. The paging terminal 106 prompts the caller for the recipient's identification, and a message to be sent. Upon receiving the required information, the paging terminal 106 returns a prompt indicating that the message has been received by the paging terminal 106. The paging terminal 106 encodes the message and places the encoded message into a transmission queue. At an appropriate time, the message is transmitted by using a transmitter 108 and a transmitting antenna 110. It will be appreciated that in a simulcast transmission system, a multiplicity of transmitters covering different geographic areas can be utilized as well.

The signal transmitted from the transmitting antenna 110 is intercepted by a receiving antenna 112 and processed by a communications device 114, shown in FIG. 1 as a paging receiver. The person being paged is alerted and the message is displayed or annunciated depending on the type of messaging being employed.

Figure 2:
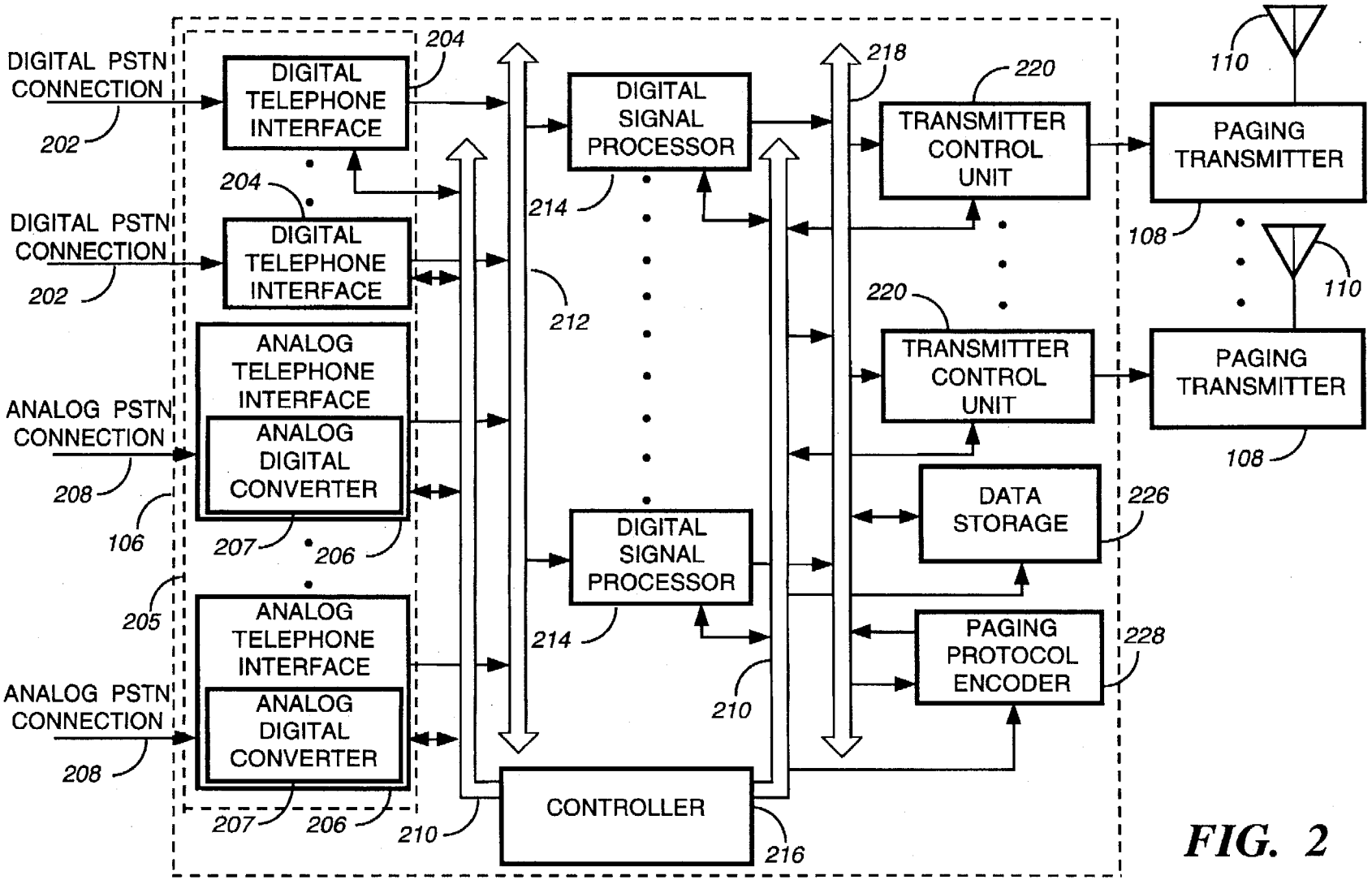
FIG. 2 is an electrical block diagram of a paging terminal and associated paging transmitters utilizing the variable rate backward search interpolation processing in accordance with the present invention.

An electrical block diagram of the paging terminal 106 and the transmitter 108 utilizing the digital voice compression process in accordance with the present invention is shown in FIG. 2. The paging terminal 106 is of a type that would be used to serve a large number of simultaneous users, such as in a commercial Radio Common Carrier (RCC) system. The paging terminal 106 utilizes a number of input devices, signal processing devices and output devices controlled by a controller 216. Communications between the controller 216 and the various devices that compose the paging terminal 106 are handled by a digital control bus 210. Communication of digitized voice and data is handled by an input time division multiplexed highway 212 and an output time division multiplexed highway 218. It will be appreciated that the digital control bus 210, input time division multiplexed highway 212 and output time division multiplexed highway 218 can be extended to provide for expansion of the paging terminal 106.

An input speech processor 205 provides the interface between the PSTN 104 and the paging terminal 106. The PSTN connections can be either a plurality of multi-call per line multiplexed digital connections shown in FIG. 2 as a digital PSTN connection 202 or plurality of single call per line analog PSTN connections 208.

Each digital PSTN connection 202 is serviced by a digital telephone interface 204. The digital telephone interface 204 provides the necessary signal conditioning, synchronization, de-multiplexing, signaling, supervision, and regulatory protection requirements for operation of the digital voice compression process in accordance with the present invention. The digital telephone interface 204 can also provide temporary storage of the digitized voice frames to facilitate interchange of time slots and time slot alignment necessary to provide an access to the input time division multiplexed highway 212. As will be described below, requests for service and supervisory responses are controlled by the controller 216. Communications between the digital telephone interface 204 and the controller 216 passes over the digital control bus 210.

Each analog PSTN connection 208 is serviced by an analog telephone interface 206. The analog telephone interface 206 provides the necessary signal conditioning, signaling, supervision, analog to digital and digital to analog conversion, and regulatory protection requirements for operation of the digital voice compression process in accordance with the present invention. The frames of digitized voice messages from the analog to digital converter 207 are temporary stored in the analog telephone interface 206 to facilitate interchange of time slots and time slot alignment necessary to provide an access to the input time division multiplexed highway 212. As will be described below, requests for service and supervisory responses are controlled by a controller 216. Communications between the analog telephone interface 206 and the controller 216 passes over the digital control bus 210.

When an incoming call is detected, a request for service is sent from the analog telephone interface 206 or the digital telephone interface 204 to the controller 216. The controller 216 selects a digital signal processor 214 from a plurality of digital signal processors. The controller 216 couples the analog telephone interface 206 or the digital telephone interface 204 requesting service to the digital signal processor 214 selected via the input time division multiplexed highway 212.

The digital signal processor 214 can be programmed to perform all of the signal processing functions required to complete the paging process. Typical signal processing functions performed by the digital signal processor 214 include digital voice compression in accordance with the present invention, dual tone multi frequency (DTMF) decoding and generation, modem tone generation and decoding, and prerecorded voice prompt generation. The digital signal processor 214 can be programmed to perform one or more of the functions described above. In the case of a digital signal processor 214 that is programmed to perform more then one task, the controller 216 assigns the particular task needed to be performed at the time the digital signal processor 214 is selected, or in the case of a digital signal processor 214 that is programmed to perform only a single task, the controller 216 selects a digital signal processor 214 programmed to perform the particular function needed to complete the next step in the paging process. The operation of the digital signal processor 214 performing dual tone multi frequency (DTMF) decoding and generation, modem tone generation and decoding, and prerecorded voice prompt generation is well known to one of ordinary skill in the art. The operation of the digital signal processor 214 performing the function of a very low bit rate variable rate backward search interpolation processing in accordance with the present invention is described in detail below.

The processing of a page request, in the case of a voice message, proceeds in the following manner. The digital signal processor 214 that is coupled to an analog telephone interface 206 or a digital telephone interface 204 then prompts the originator for a voice message. The digital signal processor 214 compresses the voice message received using a process described below. The compressed digital voice message generated by the compression process is coupled to a paging protocol encoder 228, via the output time division multiplexed highway 218, under the control of the controller 216. The paging protocol encoder 228 encodes the data into a suitable paging protocol. One such protocol which is described in detail below is the Post Office Committee Standard Advisory Group (POCSAG) protocol. It will be appreciated that other signaling protocols can be utilized as well. The controller 216 directs the paging protocol encoder 228 to store the encoded data in a data storage device 226 via the output time division multiplexed highway 218. At an appropriate time, the encoded data is downloaded into the transmitter control unit 220, under control of the controller 216, via the output time division multiplexed highway 218 and transmitted using the transmitter 108 and the transmitting antenna 110.

In the case of numeric messaging, the processing of a page request proceeds in a manner similar to the voice message with the exception of the process performed by the digital signal processor 214. The digital signal processor 214 prompts the originator for a DTMF message. The digital signal processor 214 decodes the DTMF signal received and generates a digital message. The digital message generated by the digital signal processor 214 is handled in the same way as the digital voice message generated by the digital signal processor 214 in the voice messaging case.

The processing of an alpha-numeric page proceeds in a manner similar to the voice message with the exception of the process performed by the digital signal processor 214. The digital signal processor 214 is programmed to decode and generate modem tones. The digital signal processor 214 interfaces with the originator using one of the standard user interface protocols such as the Page entry terminal (PET™) protocol. It will be appreciated that other communications protocols can be utilized as well. The digital message generated by the digital signal processor 214 is handled in the same way as the digital voice message generated by the digital signal processor 214 in the voice messaging case.

Figure 3:
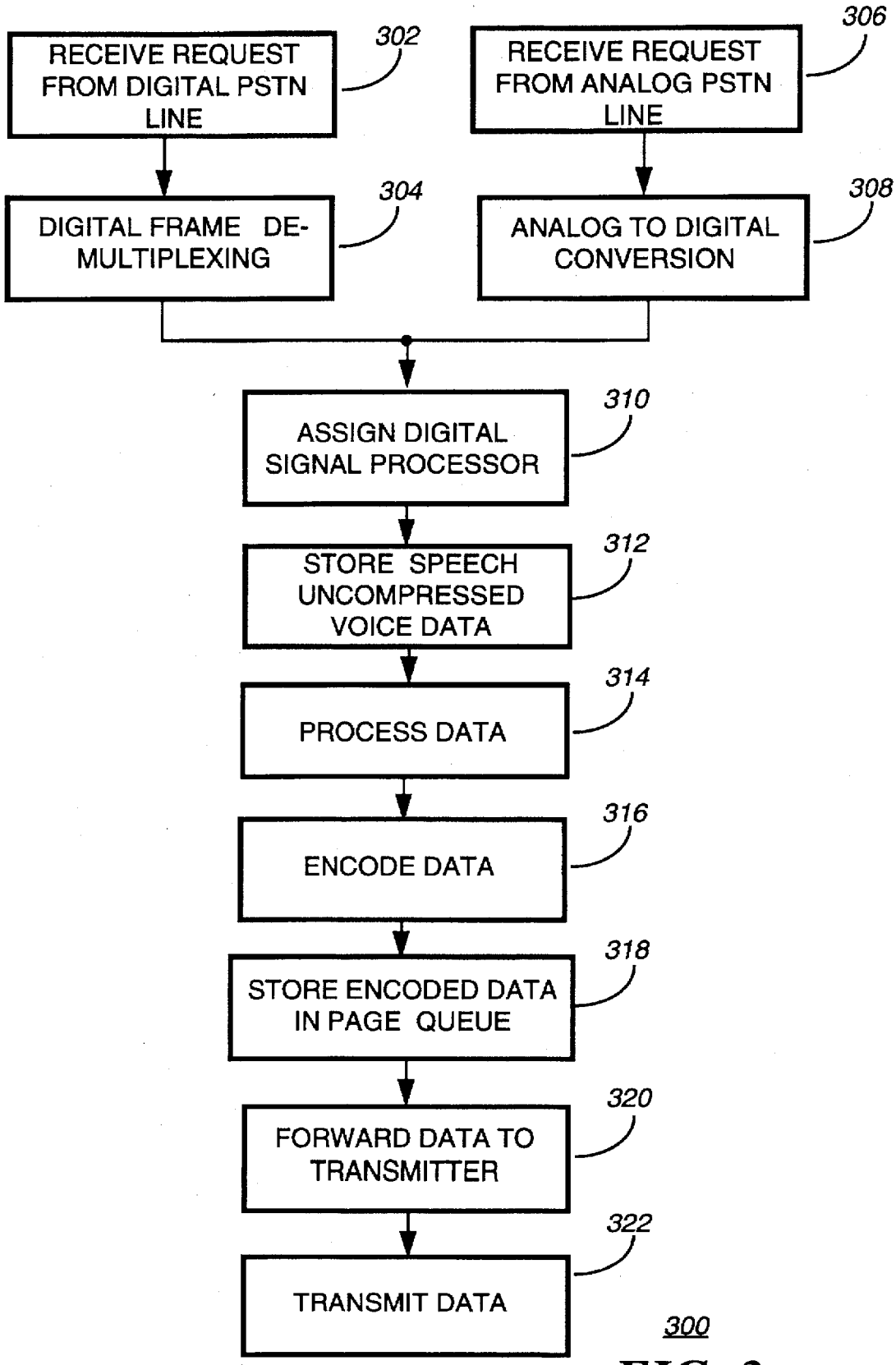
FIG. 3 is a flow chart showing the operation of the paging terminal of FIG. 2.

FIG. 3 is a flow chart which describes the operation of the paging terminal 106 shown in FIG. 2 when processing a voice message. There are shown two entry points into the flow chart 300. The first entry point is for a process associated with the digital PSTN connection 202 and the second entry point is for a process associated with the analog PSTN connection 208. In the case of the digital PSTN connection 202, the process starts with step 302, receiving a request over a digital PSTN line. Requests for service from the digital PSTN connection 202 are indicated by a bit pattern in the incoming data stream. The digital telephone interface 204 receives the request for service and communicates the request to the controller 216.

In step 304, information received from the digital channel requesting service is separated from the incoming data stream by digital frame de-multiplexing. The digital signal received from the digital PSTN connection 202 typically includes a plurality of digital channels multiplexed into an incoming data stream. The digital channels requesting service are de-multiplexed and the digitized speech data is then stored temporary to facilitate time slot alignment and multiplexing of the data onto the input time division multiplexed highway 212. A time slot for the digitized speech data on the input time division multiplexed highway 212 is assigned by the controller 216. Conversely, digitized speech data generated by the digital signal processor 214 for transmission to the digital PSTN connection 202 is formatted suitably for transmission and multiplexed into the outgoing data stream.

Similarly with the analog PSTN connection 208, the process starts with step 306 when a request from the analog PSTN line is received. On the analog PSTN connection 208, incoming calls are signaled by either low frequency AC signals or by DC signaling. The analog telephone interface 206 receives the request and communicates the request to the controller 216.

In step 308, the analog voice message is converted into a digital data stream by the analog to digital converter 207 which functions as a sampler for generating voice message samples and a digitizer for digitizing the voice message samples. The analog signal received over its total duration is referred to as the analog voice message. The analog signal is sampled, generating voice samples and then digitized, generating digital speech samples, by the analog to digital converter 207. The samples of the analog signal are referred to as voice samples. The digitized voice samples are referred to as digital speech data. The digital speech data is multiplexed onto the input time division multiplexed highway 212 in a time slot assigned by the controller 216. Conversely any voice data on the input time division multiplexed highway 212 that originates from the digital signal processor 214 undergoes a digital to analog conversion before transmission to the analog PSTN connection 208.

As shown in FIG. 3, the processing path for the analog PSTN connection 208 and the digital PSTN connection 202 converge in step 310, when a digital signal processor is assigned to handle the incoming call. The controller 216 selects a digital signal processor 214 programmed to perform the digital voice compression process. The digital signal processor 214 assigned reads the data on the input time division multiplexed highway 212 in the previously assigned time slot.

The data read by the digital signal processor 214 is stored for processing, in step 312, as uncompressed speech data. The stored uncompressed speech data is processed in step 314, which will be described in detail below. The compressed voice data derived from the processing step 314 is encoded suitably for transmission over a paging channel, in step 316. One such encoding method is the Post Office Code Standards Advisory Group (POCSAG) code. It will be appreciated that there are many other suitable encoding methods. In step 318, the encoded data is stored in a paging queue for later transmission. At the appropriate time the queued data is sent to the transmitter 108 at step 320 and transmitted, at step 322.

Figure 4:
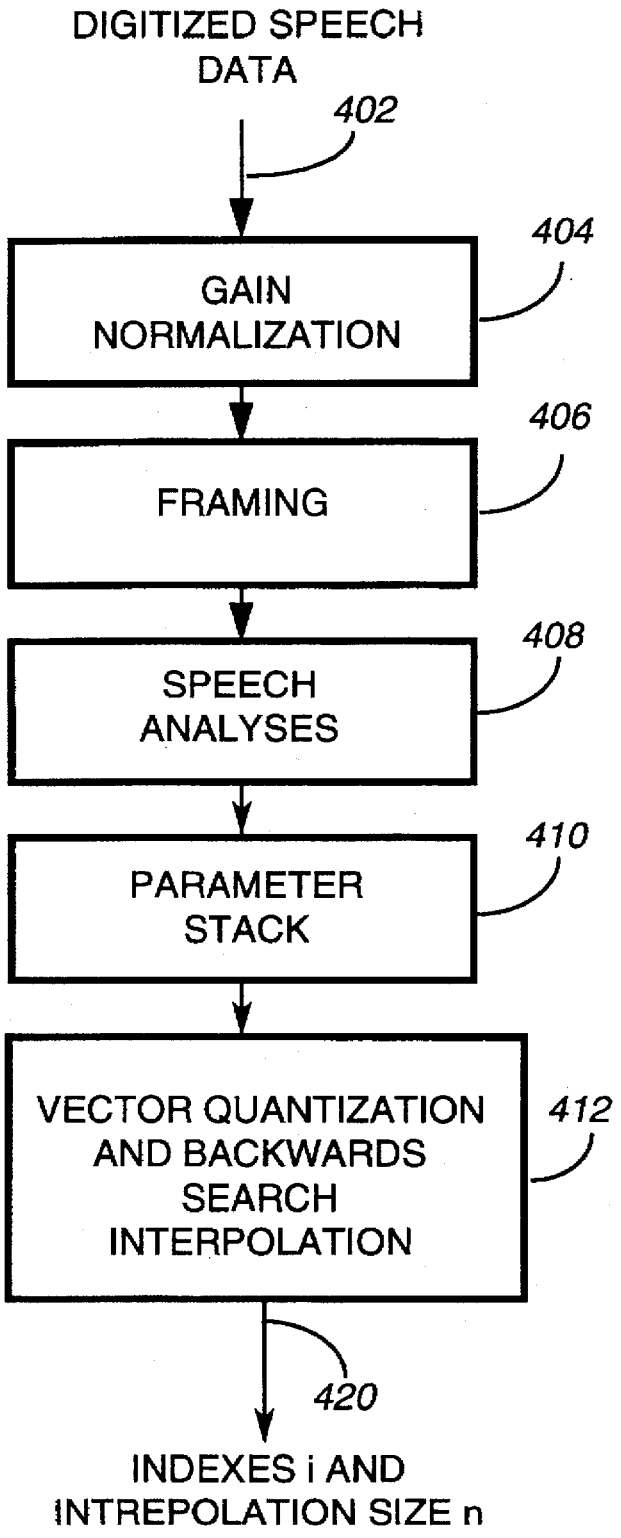
FIG. 4 is a flow chart showing the operation of a digital signal processor utilized in the paging terminal of FIG. 2.

FIG. 4 is a flow chart, detailing the voice compression process, shown at step 314, of FIG. 3 in accordance with the present invention. The steps shown in FIG. 4 are performed by the digital signal processor 214 functioning as a voice compression processor. The digital voice compression process analyzes segments of speech data to take advantage of any correlation that may exist between periods of speech. This invention utilizes the store and forward nature of a non-real time application and uses a backward search interpolation to provide variable interpolation rates. The backwards search interpolation scheme takes advantage of any inter period correlation, and transmits only data for those periods that change rapidly while using interpolation during the slowly changing periods or periods where the speech is changing in a linear manner. The digitized speech data 402 that was previously stored in the digital signal processor 214 as uncompressed voice data is analyzed at step 404 and the gain is normalized. The amplitude of the digital speech message is adjusted to fully utilize the dynamic range of the system and improve the apparent signal to noise performance.

The normalized uncompressed speech data is grouped into a predetermined number of digitized speech samples which typically represent twenty five milliseconds of speech data at step 406. The grouping of speech samples represent short duration segments of speech is referred to herein as generating speech frames. In step 408, a speech analysis is performed on the short duration segment of speech to generate speech parameters. There are many different speech analysis processes known. It will be apparent to one of ordinary skill in the art which speech analysis method will best meet the requirement of the system being designed. The speech analysis process analyses the short duration segments of speech and calculates a number of parameters in a manner well known in the art. The digital voice compression process described herein preferably calculates thirteen parameters. The first three parameters quantize the total energy in the speech segment, a characteristic pitch value, and voicing information. The remaining ten parameters are referred to as spectral parameters and basically represent coefficients of a digital filter. The speech analysis process used to generate the ten spectral parameters is typically a linear predictive code (LPC) process. The LPC parameters representing the spectral content of short duration segments of speech are referred to herein as LPC speech spectral parameter vectors and speech spectral parameter vectors. The digital signal processor 214 functions as a framer for grouping the digitized speech samples.

At step 410, the ten speech spectral parameters that were calculated in step 408 are stacked in a chronological sequence within a speech spectral parameter matrix, or parameter stack which comprises a sequence of speech spectral parameter vectors The ten speech spectral parameters occupy one row of the speech spectral parameter matrix and are referred to herein as a speech spectral parameter vector. The digital signal processor 214 functions as input speech processor to generate the speech spectral parameter vectors and while storing the speech spectral parameter vectors in chronological order. In step 412, a vector quantization and backwards search interpolation is performed on the speech spectral parameter matrix, generating data containing indexes and interpolation sizes 420, in accordance with the preferred embodiment of this invention. The vector quantization and backwards search interpolation process is described below with reference to FIG. 5.

Figure 5:
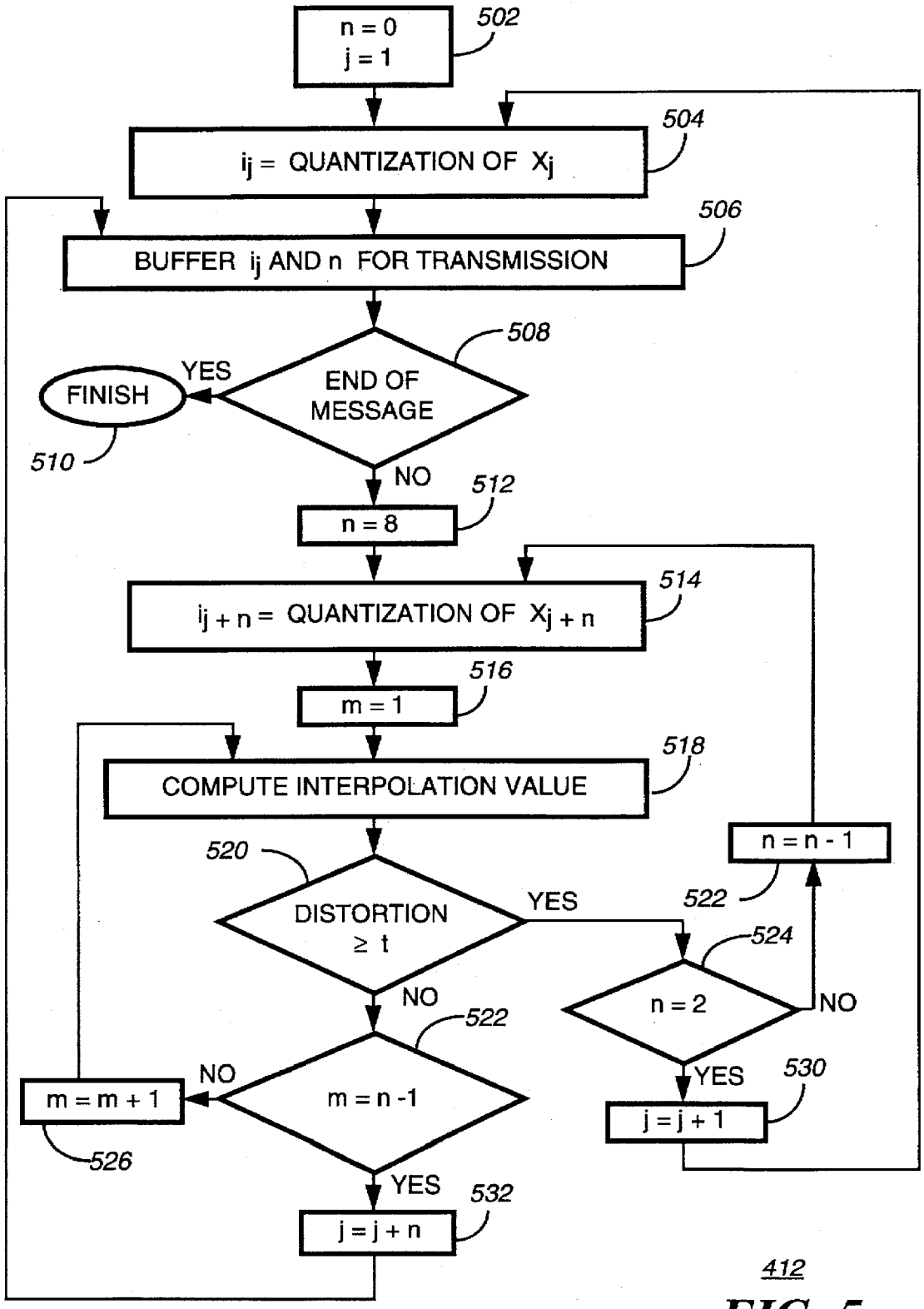
FIG. 5 is a flow chart illustrating the variable rate backward search interpolation processing utilized in the digital signal processor of FIG. 4.

FIG. 5 is flow chart detailing the vector quantization and backward search interpolation processing, shown at step 410 of FIG. 4, that is performed by the digital signal processor 214 in accordance with the preferred embodiment of the present invention. In the following description the symbol $X_j$ represents a speech spectral parameter vector calculated at step 408 and stored in the j location in the speech spectral parameter matrix. The symbol $Y_j$ represents a speech parameter template from a code book having index $i_j$. best representing the corresponding speech spectral parameter vector $X_j$. As will be described in detail below the paging terminal 106 reduces the quantity of data that must be transmitted by only transmitting an index of one speech spectral parameter template and a number n that indicates the number of speech parameter templates that are to be generated by interpolation. The number n indicates that n−1 speech parameter templates are to be generated by interpolation. For example when n=8, the subsequent speech spectral parameter vector $X_{j+n}$, where n=8, is quantized. The index of speech spectral parameter vector $X_{j+n}$ where n=0 having been already transmitted as the end point of the previous interpolation group. The seven intervening speech parameter templates corresponding to $X_{j+n}$, where n=1 through 7, are interpolated between the speech parameter template $Y_{j+n}$ where n=0 and the selected subsequent speech parameter template $Y_{j+n}$ corresponding to a subsequent index, where n=8. A test is made to determine if the intervening interpolated speech parameter templates accurately represent the original speech spectral parameter vectors. When the interpolated speech parameter template accurately represents the original speech spectral parameter vectors, the index of $Y_{j+n}$ and n is buffered for transmission. When the interpolated speech parameter template fail to accurately represent the original speech spectral parameter vectors, the value of n is reduced by one and the interpolation and testing is repeated until a acceptable value of n is found or the value of n is reduced to n=2 at which point the interpolation process is stopped and the actual index values are buffered for transmission.

Only the index of the end point of the interpolation process and the number of the speech parameter template to be generated by interpolation are transmitted. The number of speech parameter template that are to be generated by interpolation is continuously being adjusted such that during periods of rapidly changing speech fewer speech parameter templates are to be generated by interpolation and during normal periods of speech more speech parameter template are to be generated by interpolation, thus reducing the quantity of data required to be transmitted. The communications device 114 has a duplicate set of speech parameter templates and generates interpolated speech parameter templates that duplicate the interpolated speech parameter templates generated at the paging terminal 106. Because the speech parameter template that are to be generated by interpolation by the communications device 114 has been previously generated and tested by the paging terminal 106 and found to accurately represent the original speech spectral parameter vectors, the communications device 114 is will also be able to accurately reproduce the original voice message. Non real time communications systems, in particular, allow time for the computational intense backward search interpolation processing to be performed prior to transmission, although it will be appreciated that as processing speed is increased, near real time processing may be performed as well.

The process starts at step 502 where the variables, n and j, are initialized to 0 and 1 respectively. Variable n is used to indicate the number of speech parameter templates to be generated by interpolation and j is used to indicate the location of the speech spectral parameter vector in the speech spectral parameter matrix generated at step 410 that is being selected. At step 504, the selected speech spectral parameter vector is quantized. Quantization is performed by comparing the speech spectral parameter vector with a set of predetermined speech parameter templates. Quantization is also referred to as selecting the speech parameter template having the shortest distance to the speech spectral parameter vector. The set of predetermined templates is stored in the digital signal processor 214 is referred to herein as a code book. It will be shown below in a different embodiment of the present invention that two or more code books representing different dialects or languages can be provided. A code book for a paging application having one set of speech parameter templates will have by way of example two thousand forty eight templates, however it will be appreciated that a different number of templates can be used as well. Each predetermined template of a code book is identified by an index. The vector quantization function compares the speech spectral parameter vector with every speech parameter template in the code book and calculates a weighted distance between the speech spectral parameter vector and each speech parameter template. The results are stored in an index array containing the index and the weighted distance. The weighted distance is also referred to herein as a distance values. The index array is searched and the index, i of the speech parameter template, Y, having a shortest distance to the speech spectral parameter vector, X, is selected to represent the quantized value of the speech spectral parameter vector, X. The digital signal processor 214 functions as a signal processor when performing the function of a speech analyzer and a quantizer for quantizing the speech spectral parameter vectors.

The distance between a speech spectral parameter vector and a speech parameter template is typically calculated using a weighted sum of squares method. This distance is calculated by subtracting the value of one of the parameter in a given speech parameter template from a value of the corresponding parameter in the speech spectral parameter vector, squaring the result and multiplying the squared result by a corresponding weighting value in a predetermined weighting array. This calculation is repeated on every parameter in the speech spectral parameter vector and the corresponding parameters in the speech parameter template. The sum of the result of these calculations is the distance between the speech parameter template and the speech spectral parameter vector. The values of the parameters of the predetermined weighting array are determined empirically by listening test.

The distance calculation described above can be shown as the following formula:

$$d_i=\Sigma w_h(a_h-b(k)_h)^2$$

where:

$d_i$ equals the distance between the speech spectral parameter vector and the speech parameter template i of code book b, $w_h$ equals the weighting value of parameter h of the predetermined weighting array, $a_h$ equals the value of the parameter h of the speech spectral parameter vector, $b(i)_h$ equals the parameter h in speech parameter template k of the code book b and h is a index, designating a parameters in the speech spectral parameter vector or the corresponding parameter in the speech parameter template.

At step 506 the value of the index i and the variable n is stored in a buffer for later transmission. In accordance with the present invention the first speech spectral parameter vector, ($j=1$, $X_1$) is always quantized. The variable n is set to zero and n and i are buffered for transmission. At step 508 a test is made to determine if the speech spectral parameter vector buffered is the last speech spectral parameter vector of the speech message. When the speech spectral parameter vector buffered is the last speech spectral parameter vector of the speech message the process is finished at step 510. When additional speech spectral parameter vectors remain the process continues on to step 512.

At step 512 the variable n is set, by way of example to eight, establishing the maximum number of intervening speech parameter template to be generated by interpolation and selecting a subsequent speech spectral parameter vector. According to the preferred embodiment of the present invention the maximum number of speech parameter template to be generated by interpolation is seven, as established by the initial value of n, but it will be appreciated that the maximum number of speech spectral parameter vectors can be set to other values, (for example four or sixteen) as well. At step 514, the quantization of the input speech spectral parameter vector $X_{j+n}$ is performed using the process described above for step 504, determining a subsequent speech parameter template, $Y_{j+n}$, having a subsequent index, $i_{j+n}$. The template $Y_{j+n}$ and the previously determined $Y_j$ is used as end points for the interpolation process to follow. At step 516 the variable m is set to 1. The variable m is used to indicate the speech parameter template being generated by interpolation.

The interpolated speech parameter templates are calculated at step 518. The interpolation is preferably a linear interpolation process performed on a parameter by parameter basis. However it will be appreciated that other interpolation process (for example a quadratic interpolation process) can be used as well. The interpolated parameters of the interpolated speech parameter templates are calculated by taking the difference between the corresponding parameters in the speech parameter templates $Y_j$ and the speech parameter templates $Y_{j+n}$, multiplying the difference by the proportion of m/n and adding the result to $Y_j$.

The interpolation calculation described above can be shown as the following formula:

$$Y'_{(j+m)_h}=Y_{(j)_h}+m/n(Y_{(j+n)_h}-Y_{(j)_h})$$

where:

$Y'_{(j+m)_h}$ equals the interpolated value of the h parameter of the interpolated speech parameter template $Y_j'$, $Y_{(j+n)_h}$ equals the h parameter of the speech parameter template $Y_{j+n}$ and, $Y_{(j)_h}$ equals the h parameter of the speech parameter template $Y_j$.

At step 520 the interpolated speech parameter template $Y'_{(j+m)}$ is compared to the speech spectral parameter vector $X_{(j+m)}$ to determine ff the interpolated speech parameter template $Y'_{(j+m)}$ accurately represents the speech spectral parameter vector $X_{(j+m)}$. The determination of the accuracy is based upon a calculation of distortion. The distortion is typically calculated using a weighted sum of squares method. Distortion is also herein referred to as distance. The distortion is calculated by subtracting the value of a parameter of the speech spectral parameter vector $X_{(j+m)}$ from a value of a corresponding parameter of the interpolated speech parameter template $Y'_{(j+m)}$, squaring the result and multiplying the squared result by a corresponding weighting value in a predetermined weighting array. This calculation is repeated on every parameter in the speech spectral parameter vector and the corresponding parameters in the interpolated speech parameter template. The sum of results of these calculations corresponding to the each parameter is the distortion. Preferable the weighting array used to calculate the distortion is the same weighting array used in the vector quantization, however it will be appreciated that another weighting array for use in the distortion calculation can be determined empirically by listing test.

The distortion calculation described above can be shown as the following formula:

$$D=\sum_h w_h(X_{(j+m)_h}-Y'_{(j+m)_h})^2$$

where:

D equals the distortion between the speech spectral parameter vector $X_{j(j+m)}$, and interpolated speech parameter template $Y'_{(j+m)}$, $w_h$ equals the weighting value of parameter h of the predetermined weighting array, The distortion D is compared to a predetermined distortion limit t. The predetermined distortion limit t is also referred to herein as a predetermined distance. When the distortion is equal to or less than the predetermined distortion limit t, a test is made to determine if the value of m is equal to n−1. When the value of m is equal to n−1 the distortion for all of the interpolated templates have been calculated and found to accurately represents the original speech spectral parameter vectors and at step 532 the value of j is set equal to j+n, corresponding to the index of the speech parameter template $Y_{j+n}$, used in the interpolation process. Then at step 506 the value of the index i corresponding to the speech parameter template $Y_{j+n}$ and the variable n is stored in a buffer for later transmission. Thus replacing the first speech spectral parameter vector with the subsequent speech spectral parameter vector. The process continues until the end of the message is detected at step 508. When at step 528 the value of m is not equal to n−1, not all of the interpolated speech parameter templates have been calculated and tested. Than at step 526 the value of m is incremented by 1 and the next interpolated parameter is calculated at step 518.

When at step 520 the distortion is greater than the predetermined distortion limit t, the rate of change of the speech spectral parameters vectors is greater than that which can be accurately reproduced with the current interpolation range as determined by the value of n. Then at step 524 a test is made to determine if the value of n is equal to 2. When the value of n is not equal to 2, then at step 522 the size of interpolation range is reduced by reducing the value of n by 1. When at step 524 the value of n is equal to 2, further reduction in the value of n is not useful. Then at step 530 the value of j is incremented by one and no interpolation is performed. Next at step 504 the speech spectral parameter vector $X_j$ is quantized and buffered for transmission at step 506.

Figure 6:
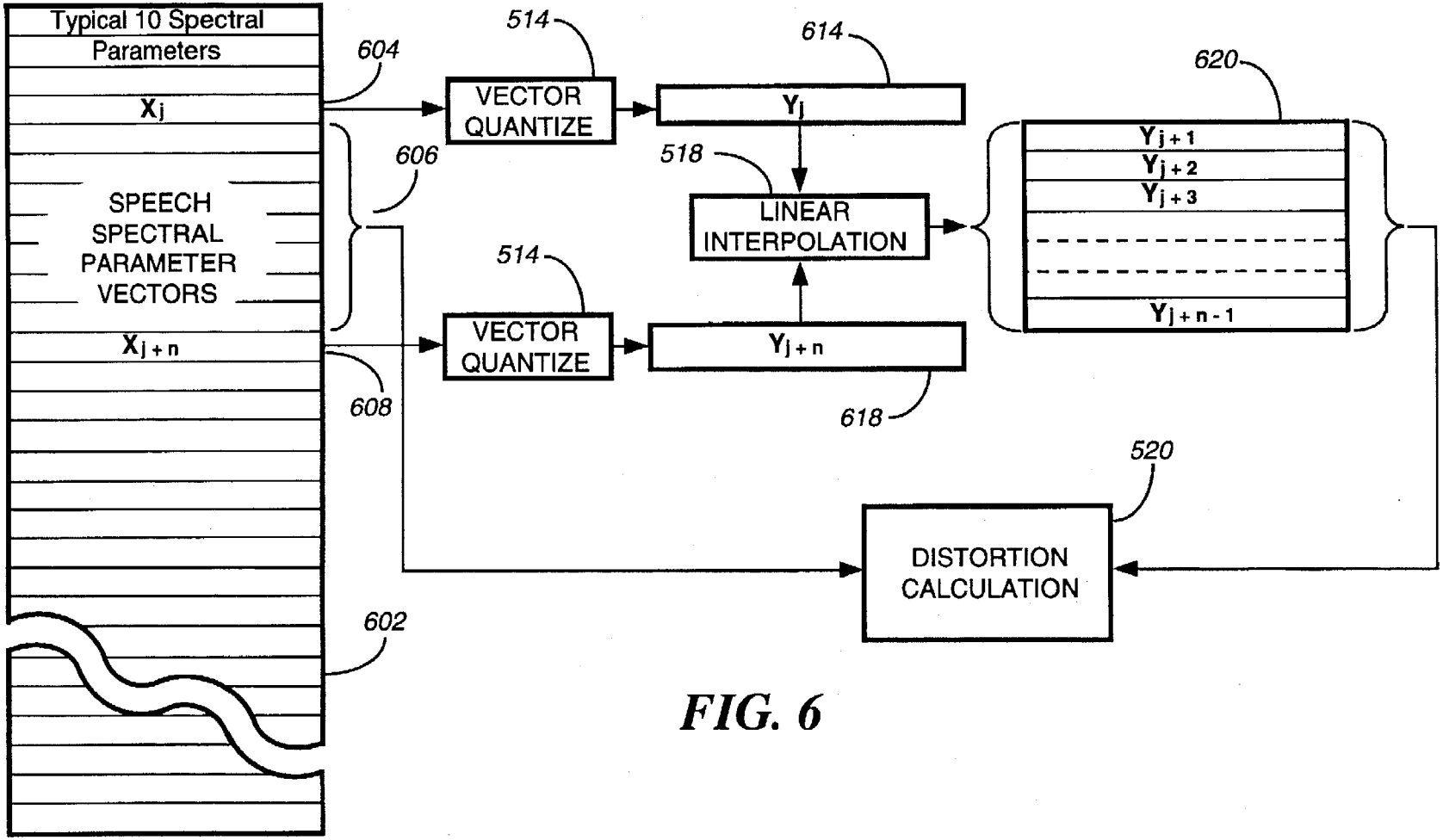
FIG. 6 is a diagram illustrating a portion of the digital voice compression process utilized in the digital signal processor of FIG. 4.

FIG. 6 is a graphic representation of the interpolation and distortion test described in step 512 through step 520 of FIG.

5. The speech spectral parameter matrix 602 is an array of speech spectral parameter vectors including the speech spectral parameter vector 604, $X_j$ and subsequent speech spectral parameter vector 608, $X_{j+n}$. The bracket encloses the intervening speech spectral parameter vectors 606, the n−1 speech parameter template that will be generated by interpolation. This illustration depicts a time at which n is equal to 8 and therefore seven speech parameter templates will be generated by interpolation. The speech spectral parameter vector 604, $X_j$, is vector quantized at step 514 producing an index corresponding to a speech parameter template 614, $Y_j$, that best represents the speech spectral parameter vector 604, $X_j$. Similarly, the subsequent speech spectral parameter vector 608, $X_{j+n}$, is vector quantized at step 514 producing an index corresponding to a subsequent speech parameter template 618, $Y_{j+n}$, that best represents the subsequent speech spectral parameter vector 608, $X_{j+n}$. The values for the parameters of the interpolated speech parameter template 620, $Y'_{j+m}$, are generated by linear interpolation at step 518. As each interpolated speech parameter template 620, $Y_{j+m}'$, is calculated, it is compared with the corresponding original speech spectral parameter vectors $X_{j+m}$ in the speech spectral parameter matrix 602. When the comparison indicates that the distortion calculated by distortion calculation at step 520 exceeds a predetermined distortion limit the value of n is reduced, as described above and the process repeated. The predetermined distortion limit is also herein referred to as a predetermined distance limit.

In an alternate embodiment of the present invention, more than one set of speech parameter templates or code books can be provided to better represent different speakers. For example, one code book can be used to represent a female speaker's voice and a second code book can be used to represent a male speaker's voice. It will be appreciated that additional code books reflecting language differentiation, such as Spanish, Japanese, etc., can be provided as well. When multiple code books are utilized, different PSTN telephone access numbers can be used to differentiate between different languages. Each unique PSTN access number is associated with group of PSTN connections and each group of PSTN connections corresponds to a particular language and corresponding code books. When unique FSTN access number are not used, the user can be prompted to provide information by enter a predetermined code, such as a DTMF digit, prior to entering a voice message, with each DTMF digit corresponding to a particular language and corresponding code books. Once the language of the originator is identified by the PSTN line used or the DTMF digit received, the digital signal processor 214 selects a set of predetermined templates which represent a code book corresponding to the predetermined language from a set of predetermined code books stored in the digital signal processor 214 memory. All voice prompts thereafter can be given in the language identified. The input speech processor 205 receives the information identifying the language and transfers the information to a digital signal processor 214. Alternatively the digital signal processor 214 can analyze the digital speech data to determine the language or dialect and selects an appropriate code book.

Code book identifiers are used to identify the code book that was used to compress the voice message. The code book identifiers are encoded along with the series of indexes and sent to the communications device 114. An alternate method of conveying the code book identity is to add a header, identifying the code book, to the message containing the index data.

Figure 7:
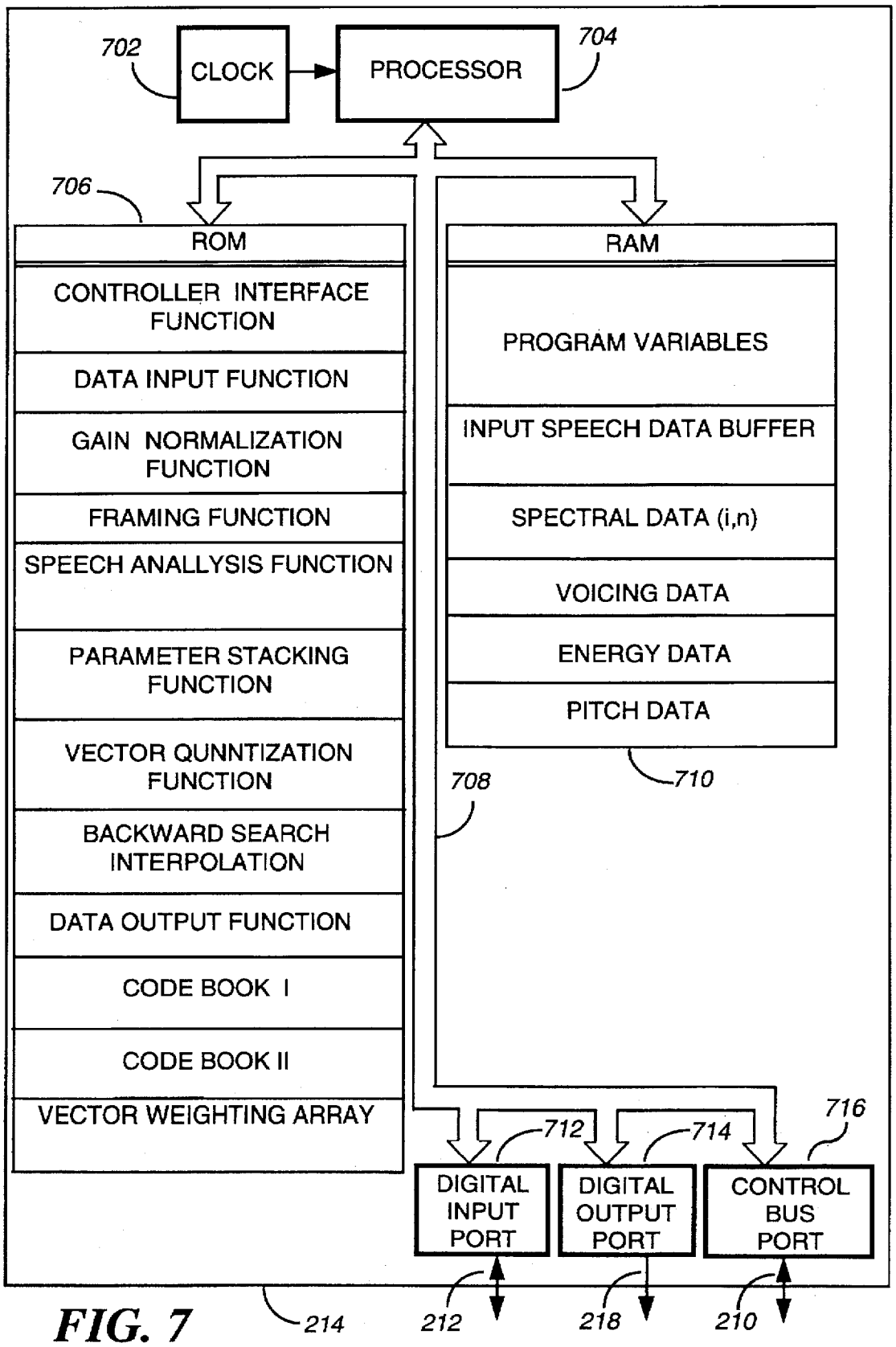
FIG. 7 is an electrical block diagram of the digital signal processor utilized in the paging terminal of FIG. 2.

FIG. 7 shows an electrical block diagram of the digital signal processor 214 utilized in the paging terminal 106 shown in FIG. 2. A processor 704, such as one of several standard commercial available digital signal processor ICs specifically designed to perform the computations associated with digital signal processing, is utilized. Digital signal processor ICs are available from several different manufactures, such as a DSP56100 manufactured by Motorola Inc. of Schaumburg, Ill. The processor 704 is coupled to a ROM 706, a RAM 710, a digital input port 712, a digital output port 714, and a control bus port 716, via the processor address and data bus 708. The ROM 706 stores the instructions used by the processor 704 to perform the signal processing function required for the type of messaging being used and control interface with the controller 216. The ROM 706 also contains the instructions used to perform the functions associated with compressed voice messaging. The RAM 710 provides temporary storage of data and program variables, the input voice data buffer, and the output voice data buffer. The digital input port 712 provides the interface between the processor 704 and the input time division multiplexed highway 212 under control of a data input function and a data output function. The digital output port provides an interface between processor 704 and the output time division multiplexed highway 218 under control of the data output function. The control bus port 716 provides an interface between the processor 704 and the digital control bus 210. A dock 702 generates a timing signal for the processor 704.

The ROM 706 contains by way of example the following: a controller interface function routine, a data input function routine, a gain normalization function routine, a framing function routine, a speech analysis function routine, a vector quantizing function routine, a backward search interpolation function routine, a data output function routine, one or more code books, and the matrix weighting array as described above. RAM 710 provides temporary storage for the program variables, an input speech data buffer, and an output speech buffer. It will be appreciated that elements of the ROM 706, such as the code book, can be stored in a separate mass storage medium, such as a hard disk drive or other similar storage devices.

Figure 8:
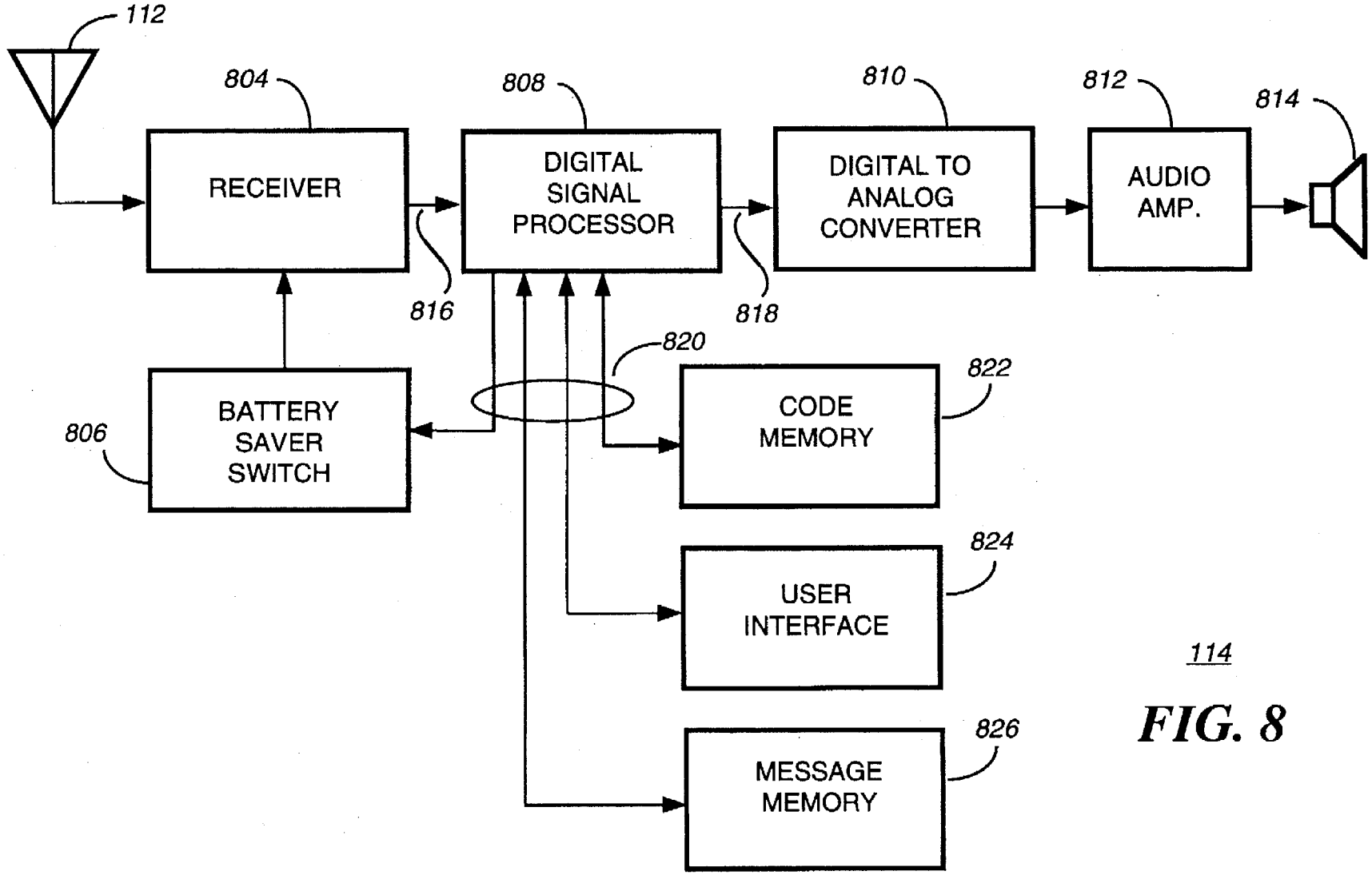
FIG. 8 is an electrical block diagram of a receiver utilizing the digital voice compression process in accordance with the present invention

FIG. 8 is an electrical block diagram of the communications device 114 such as a paging receiver. The signal transmitted from the transmitting antenna 110 is intercepted by the receiving antenna 112. The receiving antenna 112 is coupled to a receiver 804. The receiver 804 processes the signal received by the receiving antenna 112 and produces a receiver output signal 816 which is a replica of the encoded data transmitted. The encoded data is encoded in a predetermined signaling protocol, such as a POCSAG protocol. A digital signal processor 808 processes the receiver output signal 816 and produces a decompressed digital speech data 818 as will be described below. A digital to analog converter converts the decompressed digital speech data 818 to an analog signal that is amplified by the audio amplifier 812 and annunciated by speaker 814.

The digital signal processor 808 also provides the basic control of the various functions of the communications device 114. The digital signal processor 808 is coupled to a battery saver switch 806, a code memory 822, a user interface 824, and a message memory 826, via the control bus 820. The code memory 822 stores unique identification information or address information, necessary for the controller to implement the selective call feature. The user interface 824 provides the user with an audio, visual or mechanical signal indicating the reception of a message and can also include a display and push buttons for the user to input commands to control the receiver. The message memory 826 provides a place to store messages for future review, or to allow the user to repeat the message. The battery saver switch 806 provide a means of selectively disabling the supply of power to the receiver during a period when the system is communicating with other pagers or not transmitting, thereby reducing power consumption and extending battery life in a manner well known to one ordinarily skilled in the art.

Figure 9:
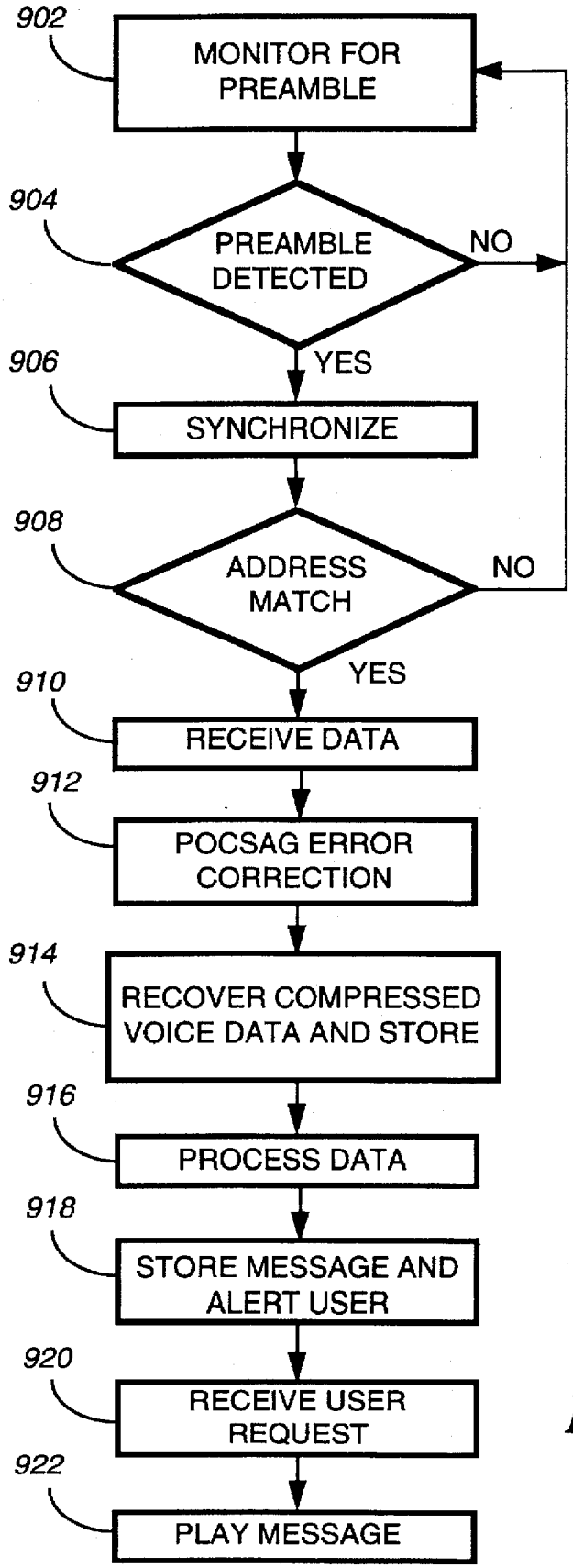
FIG. 9 is a flow chart showing the operation of the receiver of FIG. 8.

FIG. 9 is a flow chart which describes the operation of the communications device 114. In step 902, the digital signal processor 808 sends a command to the battery saver switch 806 to supply power to the receiver 804. The digital signal processor 808 monitors the receiver output signal 816 for a bit pattern indicating that the paging terminal is transmitting a signal modulated with a POCSAG preamble.

In step 904, a decision is made as to the presence of the POCSAG preamble. When no preamble is detected, then the digital signal processor 808 sends a command to the battery saver switch 806 inhibits the supply of power to the receiver for a predetermined length of time. After the predetermined length of time, at step 902, monitoring for preamble is again repeated as is well known in the art. In step 906, when a POCSAG preamble is detected the digital signal processor 808 will synchronize with the receiver output signal 816.

When synchronization is achieved, the digital signal processor 808 may issue a command to the battery saver switch 806 to disable the supply of power to the receiver until the POCSAG frame assigned to the communications device 114 is expected. At the assigned POCSAG frame, the digital signal processor 808 sends a command to the bakery saver switch 806, to supply power to the receiver 804. In step 908, the digital signal processor 808 monitors the receiver output signal 816 for an address that matches the address assigned to the communications device 114. When no match is found the digital signal processor 808 send a command to the battery saver switch 806 to inhibit the supply of power to the receiver until the next transmission of a synchronization code word or the next assigned POCSAG frame, after which step 902 is repeated. When an address match is found then in step 910, power is maintained to the receive and the data is received.

In step 912, error correction can be performed on the data received in step 910 to improve the quality of the voice reproduced. The POCSAG encoded frame provides nine parity bits which are used in the error correction process. POCSAG error correction techniques are well known to one ordinarily skilled in the art. The corrected data is stored in step 914. The stored data is processed in step 916. The processing of digital voice data, dequantizes and interpolates the spectral information, combines the spectral information with the excitation information and synthesizes the voice date.

In step 918, the digital signal processor 808 stores the voice data, received in the message memory 826 and sends a command to the user interface to alert the user. In step 920, the user enters a command to play out the message. In step 922, the digital signal processor 808 responds by passing the decompressed voice data that is stored in message memory to the digital to analog converter 810. The digital to analog converter 810 converts the digital speech data 818 to an analog signal that is amplified by the audio amplifier 812 and annunciated by speaker 814.

Figure 10:
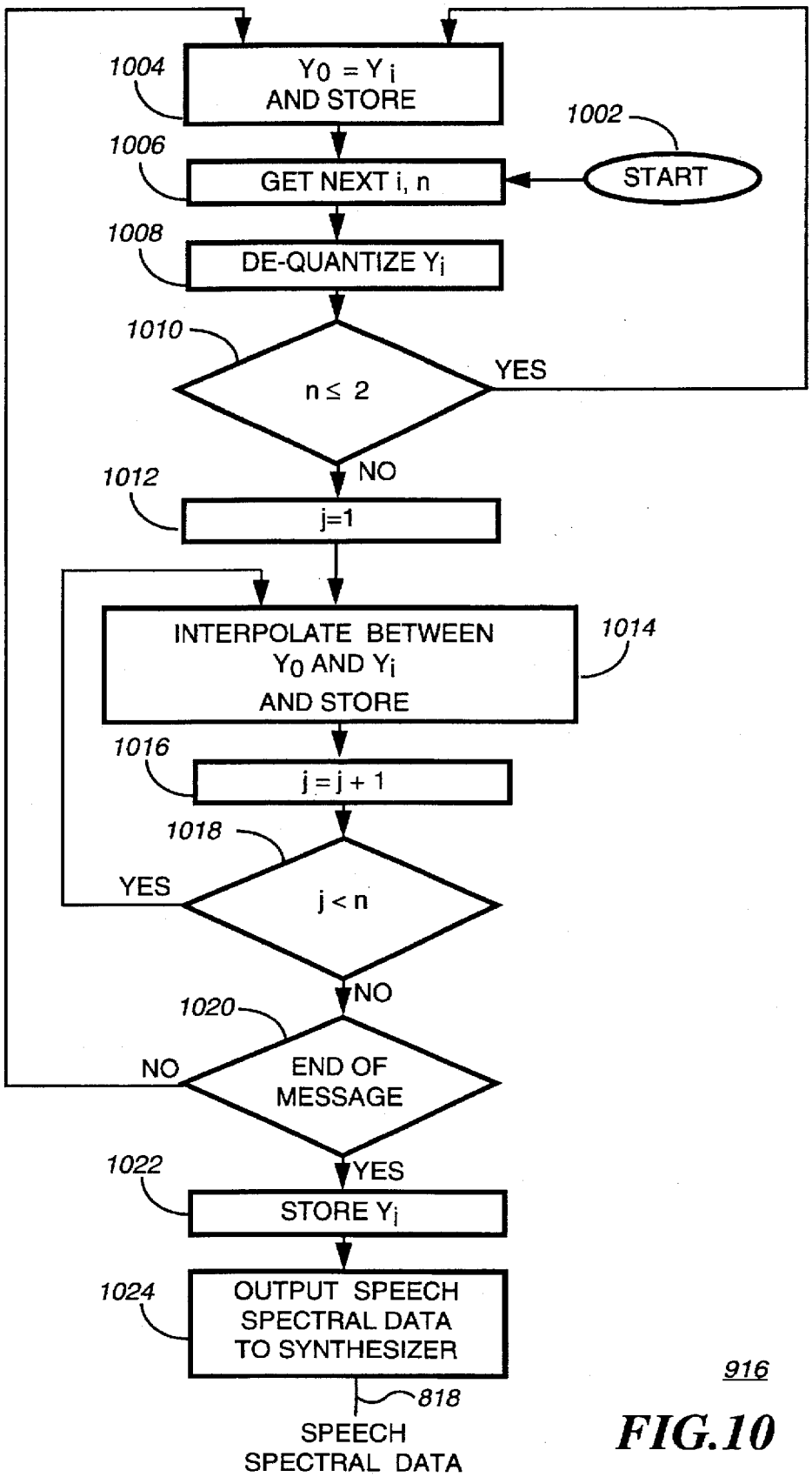
FIG. 10 is a flow chart showing the variable rate interpolation processing utilized in the receiver of FIG. 8.

FIG. 10 is a flow chart showing the variable rate interpolation processing performed by the digital signal processor 808 at step 916. The process starts at step 1002 which lead directly to step 1006. At step 1006 the first index i and interpolation range is n is retrieved from storage. At step 1008 the index i is used to retrieve the speech parameter template $Y_i$ from the selected code book stored in the digital signal processor 808. Next at step 1010 a test is made to determine if the value of n is equal to or less than two. When the value of n is equal to or less than two no interpolation is performed and at step 1004 the speech parameter template is stored. It shall be noted that the first index transmitted, n is always set to zero at step 502 by the paging terminal 106. At step 1004 the speech parameter template $Y_i$ is temporary stored at a register $Y_0$. The speech parameter template stored at a register $Y_0$ is hereafter referred to as speech parameter template $Y_0$. Also at step 1004 the speech parameter template $Y_i$ is stored in a output speech buffer in the digital signal processor 808. Next at step 1006 the next index i and the next interpolation range n is retrieved from storage. Next at step 1008 the index i is used to retrieve the speech parameter template $Y_i$ from the code book. Then at step 1010 a test is made to determine if the value of n is equal to or less than two. When the value of n is greater than two, the value of the variable j is set to one at step 1012. Next, at step 1014, the speech parameter template $Y_j'$ is interpolated and stored in the next location of the output speech buffer.

The interpolation process is essentially the same as the interpolation process performed in the paging terminal 106 prior to transmission of the message at step 518. The process linearly interpolates the parameters of the speech parameter templates $Y_j'$ between speech parameter template $Y_0$ and the speech parameter template $Y_i$. The interpolated parameters of the interpolated parameter templates are calculated by taking the difference between the corresponding parameters in the speech parameter templates $Y_0$ and the speech parameter templates $Y_i$, multiplying the difference by the proportion of j/n and adding the result to $Y_j$.

The interpolation calculation described above can be shown as the following formula:

$$Y'_{(j)_h}=Y_{(0)_h}+j/n(Y_{(i)_h}-Y_{(o)_h})$$

where:

$Y'_{(j)_h}$ equals the interpolated value of the h parameter of the interpolated speech parameter template $Y_j'$, $Y_{(i)_h}$ equals the h parameter of the speech parameter template $Y_i$ and, $Y_{(0)_h}$ equals the h parameter of the speech parameter template $Y_0$.

Next, at step 1016, the value of j is incremented by 1, indicating the next speech parameter template to be interpolated. Next at step 1020 a test is made to determine if j less then n. When j is less then n then there are more speech parameter templates to be generated by interpolation and the process continues at step 1004. When j is equal to n all of the interpolated speech parameter templates in that interpolation group have been calculated and step 1020 is performed next.

At step 1020 a test is made to determine if the end of the message has been reached. When the end of the file has not been reached the process continues at step 1004. When the end of the file has been reached then at step 1022 the last decoded speech parameter template $Y_i$ is stored in the output speech buffer. Next at step 1024 the spectral information is combined with the excitation information and the digital speech data 818 is synthesized.

Figure 11:
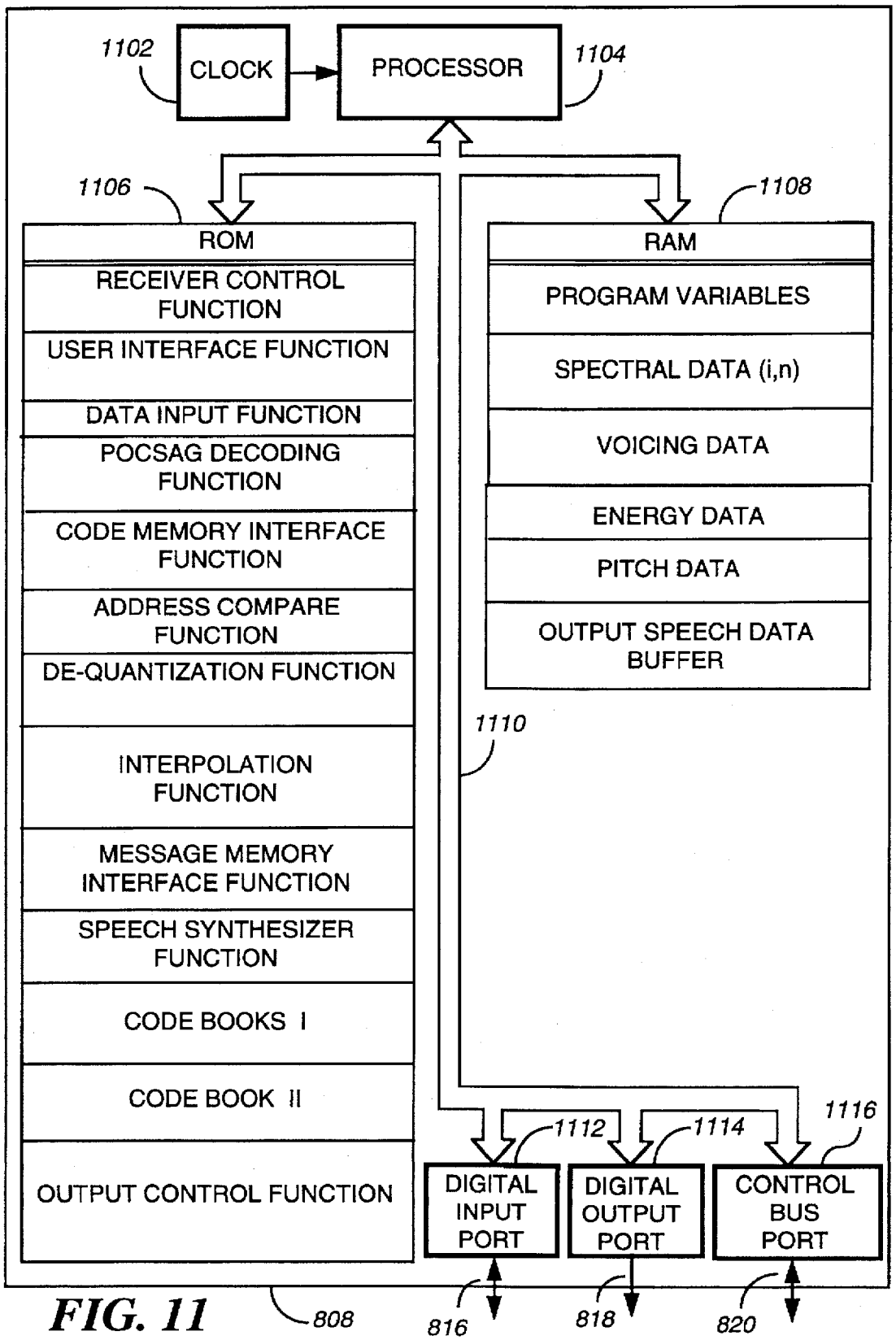
FIG. 11 is an electrical block diagram of the digital signal processor utilized in the paging receiver of FIG. 8.

FIG. 11 shows an electrical block diagram of the digital signal processor 808 used in the communications device 114. The processor 1104 is similar to the processor 704 shown in FIG. 7. However because the quantity of computation performed when decompressing the digital voice message is much less then the amount of computation performed during the compression process, and the power consumption is critical in communications device 114, the processor 1104 can be a slower, lower power version. The processor 1104 is coupled to a ROM 1106, a RAM 1108, a digital input port 1112, a digital output port 1114, and a control bus port 1116, via the processor address and data bus 1110. The ROM 1106 stores the instructions used by the processor 1104 to perform the signal processing function required to decompress the message and to interface with the control bus port 1116. The ROM 1106 also contains the instruction to perform the functions associated with compressed voice messaging. The RAM 1108 provides temporary storage of data and program variables. The digital input port 1112 provides the interface between the processor 1104 and the receiver 804 under control of the data input function. The digital output port 1114 provides the interface between the processor 1104 and the digital to analog converter under control of the output control function. The control bus port 1116 provides an interface between the processor 1104 and the control bus 820. A dock 1102 generates a timing signal for the processor 1104.

The ROM 1106 contains by way of example the following: a receiver control function routine, a user interface function routine, a data input function routine, a POCSAG decoding function routine, a code memory interface function routine, an address compare function routine, a dequantization function routine, an inverse two dimensional transform function routine, a message memory interface function routine, a speech synthesizer function routine, an output control function routine and one or more code books as described above. One or more code books corresponding to one or more predetermined languages are be stored in the ROM 1106. The appropriate code book will be selected by the digital signal processor 808 based on the identifier encoded with the received data in the receiver output signal 816.

In summary, speech sampled at a 8 KHz rate and encoded using conventional telephone techniques requires a data rate of 64 Kilo bits per second. However as speech encoded in accordance with the present requires a substantial slower transmission rate. For example speech sampled at a 8 KHz rate and grouped into frames representing 25 milliseconds of speech in accordance with the present invention can be transmitted at an average data rate of 400 bit per second. As hitherto stated, the present invention digitally encodes the voice messages in such a way that the resulting data is very highly compressed and can easily be mixed with the normal data sent over the paging channel. In addition the voice message is digitally encodes in such a way, that processing in the pager, or similar portable device is minimized. While specific embodiments of this invention have been shown and described, it can be appreciated that further modification and improvement will occur to those skilled in the art.

We claim:

1. A method for providing a low bit rate speech transmission, wherein speech spectral parameter vectors are generated from a voice message and stored in a sequence within a speech spectral parameter matrix, and wherein an index identifying a speech parameter template corresponding to a selected speech spectral parameter vector of the sequence is transmitted, and thereafter said method comprising the steps of:

selecting a subsequent speech spectral parameter vector of the sequence to establish one or more intervening speech spectral parameter vectors with respect to the selected speech spectral parameter vector;

determining a subsequent index identifying a subsequent speech parameter template corresponding to the subsequent speech spectral parameter vector of the sequence;

interpolating between the speech parameter template and the subsequent speech parameter template to derive one or more intervening interpolated speech parameter templates;

comparing each of the one or more intervening speech spectral parameter vectors to a corresponding one of the one or more intervening interpolated speech parameter templates to derive one or more distances and transmitting the subsequent index when each of the one or more distances derived is less than or equal to a predetermined distance.

2. The method according to claim 1, wherein said step of transmitting further transmits a number of intervening speech spectral parameter vectors corresponding to the one or more intervening speech spectral parameter vectors established.

3. The method according to claim 1, further comprising the steps of:

replacing the selected speech spectral parameter vector with the subsequent speech spectral parameter vector;

selecting a further subsequent speech spectral parameter vector which replaces the subsequent speech spectral parameter vector; and repeating said step of determining, interpolating, comparing and transmitting.

4. The method according to claim 3, wherein said step of replacing, selecting, determining, interpolating, comparing and transmitting are repeated until the voice message is transmitted.

5. The method according to claim 1, wherein the one or more intervening speech spectral parameter vectors corresponds to a predetermined number of intervening speech spectral parameter vectors.

6. The method according to claim 1, further comprising the steps of:

selecting a subsequent speech spectral parameter vector from the one or more intervening speech spectral parameter vectors to establish one or more intervening speech spectral parameter vectors with respect to the selected speech spectral parameter vector when any one of the one or more distances derived in said step of comparing is greater than the predetermined distance; and repeating the steps of determining, interpolating, comparing and transmitting.

7. The method according to claim 1, wherein the speech spectral parameter vectors are LPC speech spectral parameter vectors.

8. The method according to claim 1, wherein the speech parameter template and the subsequent speech parameter template are selected from a set of predetermined speech parameter templates.

9. The method according to claim 8, wherein the set of predetermined speech parameter templates represents a code book which corresponds to a predetermined language.

10. The method according to claim 2 further comprising the steps of:

storing the number of intervening speech spectral parameter vectors;

storing the index and the subsequent index in an index array; and transmitting the number of intervening speech spectral parameter vectors and the index array which are stored.

11. A voice compression processor for processing a voice message to provide a low bit rate speech transmission, said voice compression processor comprising:

a memory for storing speech parameter templates and indexes identifying the speech parameter templates;

an input speech processor for processing the voice message to generate speech spectral parameter vectors which are stored in a sequence within said memory;

a signal processor programmed to select a speech spectral parameter vector from the sequence of speech spectral parameter vectors stored within said memory, determine an index identifying a speech parameter template corresponding to a selected speech spectral parameter vector, select a subsequent speech spectral parameter vector from the sequence of speech spectral parameter vectors stored within said memory, the subsequent speech spectral parameter vector establishing one or more intervening speech spectral parameter vectors with respect to the selected speech spectral parameter vector, determine a subsequent index identifying a subsequent speech parameter template corresponding to the subsequent speech spectral parameter vector, interpolate between the speech parameter template and the subsequent speech parameter template to derive one or more intervening interpolated speech parameter templates, compare the one or more intervening speech spectral parameter vectors corresponding to the one or more intervening interpolated speech parameter templates to derive one or more distances, and selecting the subsequent index for transmission when the one or more distances derived are less than or equal to a predetermined distance; and a transmitter, responsive to said signal processor, for transmitting the index, and thereafter for transmitting the subsequent index selected for transmission.

12. The voice compression processor according to claim 11, wherein said transmitter further transmits a number of intervening speech spectral parameter vectors corresponding to the one or more intervening speech spectral parameter vectors established.

13. The voice compression processor according to claim 11, wherein said signal processor is programmed to replace the selected speech spectral parameter vector with the subsequent speech spectral parameter vector, select a further subsequent speech spectral parameter vector which replaces the subsequent speech spectral parameter vector, and further select, determine, interpolate, and compare.

14. The voice compression processor according to claim 13, wherein said signal processor further selects, determines, interpolates, compares and transmits until the voice message is transmitted.

15. The voice compression processor according to claim 11, wherein the one or more intervening speech spectral parameter vectors correspond to a predetermined number of intervening speech spectral parameter vectors.

16. The voice compression processor according to claim 11, wherein the signal processor is further programmed to select a subsequent speech spectral parameter vector from the one or more intervening speech spectral parameter vectors to establish one or more intervening speech spectral parameter vectors with respect to the selected speech spectral parameter vector when any one of the one or more distances derived is greater than the predetermined distance; and further determine, interpolate, compare and transmit.

17. The voice compression processor according to claim 11, wherein the speech spectral parameter vectors are LPC speech spectral parameter vectors.

18. The voice compression processor according to claim 11, wherein the speech parameter template and the subsequent speech parameter template are selected from a set of speech parameter templates stored within said memory.

19. The voice compression processor according to claim 11, wherein the set of speech parameter templates represents a code book which corresponds to a predetermined language.

20. The voice compression processor according to claim 12, wherein said memory further stores the number of intervening speech spectral parameter vectors, and further for storing the index and the subsequent index in an index array, and wherein said transmitter transmits the number of intervening speech spectral parameter vectors and the index array which are stored.

21. A method for processing a low bit rate speech transmission to provide a voice message, said method comprising the steps of:

receiving an index, at least a subsequent index and a a number defining the number of intervening speech spectral parameter vectors to be derived by interpolating;

selecting a speech parameter template corresponding to the index and a subsequent speech parameter template corresponding to a subsequent index from a set of predetermined speech parameter templates;

interpolating between the selected speech parameter template and the subsequent speech parameter template to derive a number of intervening speech parameter templates corresponding to the number of intervening speech spectral parameter vectors defined by the number;

synthesizing speech data from the selected speech parameter template, the subsequent speech parameter template, and the number of intervening speech parameter templates derived by interpolating; and generating the voice message from the speech data synthesized.

22. The method according to claim 21 further comprising the step of storing the index, the subsequent index, and the number defining the number of intervening speech spectral parameter vectors to be derived by interpolating.

23. The method according to claim 21 further comprising the step of storing the selected speech parameter template, the number of intervening speech parameter templates, and the subsequent speech parameter template.

24. The method according to claim 21, wherein the set of predetermined templates represents a code book which corresponds to a predetermined language.

25. The method according to claim 21, wherein the number defining the number of intervening speech spectral parameter vectors is variable.

26. The method according to claim 21, wherein said method further comprises the steps of:

replacing the selected speech parameter template with the subsequent speech parameter template;

receiving a further subsequent index and a number defining the number of intervening speech spectral parameter vectors between the further subsequent index and the subsequent index; and repeating the steps of selecting, interpolating, synthesizing and generating to deliver the voice message.

27. A communications device for receiving a low bit rate speech transmission to provide a voice message, said communications device comprising:

a memory for storing a set of speech parameter templates;

a receiver for receiving an index, a subsequent index and a number defining the number of intervening speech spectral parameter vectors to be derived by interpolating;

a signal processor programmed to select a speech parameter template corresponding to the index and a subsequent speech parameter template corresponding to the subsequent index from the set of predetermined speech parameter templates, and interpolate between the speech parameter template and the subsequent speech parameter template to derive the number of intervening speech parameter templates corresponding to the number of intervening speech spectral parameter vectors defined by the number;

a synthesizer for synthesizing speech data from the speech parameter template, the subsequent speech parameter template, and the number of intervening speech parameter templates derived by interpolating; and a converter for generating the voice message from the speech data synthesized.

28. The communications device according to claim 27 wherein said memory further stores the first index, the subsequent index, and the number defining the number of intervening speech spectral parameter vectors to be derived by interpolating.

29. The communications device according to claim 27 wherein said memory further stores the speech parameter template, the number of intervening speech parameter templates derived by interpolating, and the subsequent parameter template.

30. The communications device according to claim 28, wherein the set of speech parameter templates stored in said memory represents a code book which corresponds to a predetermined language.

31. The communications device according to claim 27, wherein the number defining the number of intervening speech spectral parameter vectors is variable.

32. The communications device according to claim 27, and wherein said receiver receives a further subsequent index and a number defining the number of intervening speech spectral parameter vectors between the further subsequent index and the subsequent index, and wherein said signal processor is further programmed to replace the selected speech parameter template with the subsequent speech parameter template, replace the subsequent speech parameter template with the further subsequent speech parameter template, and further select, interpolate, synthesize and generate to deliver the voice message.

* * * * *